US011728567B2

(12) United States Patent
Ivey et al.

(10) Patent No.: US 11,728,567 B2
(45) Date of Patent: Aug. 15, 2023

(54) SYSTEMS AND METHODS FOR IDENTIFYING AND PRIORITIZING ANTENNA CANISTER COMPONENTS FOR AN ANTENNA CANISTER

(71) Applicant: DISH Wireless L.L.C., Englewood, CO (US)

(72) Inventors: Greg Ivey, Highlands Ranch, CO (US); Joseph Oliver, Denver, CO (US)

(73) Assignee: DISH WIRELESS L.L.C., Englewood, CO (US)

( * ) Notice: Subject to any disclaimer, the term of this patent is extended or adjusted under 35 U.S.C. 154(b) by 33 days.

(21) Appl. No.: 17/568,397

(22) Filed: Jan. 4, 2022

(65) Prior Publication Data

US 2023/0216185 A1 Jul. 6, 2023

(51) Int. Cl.
*H01Q 1/42* (2006.01)

(52) U.S. Cl.
CPC ..... *H01Q 1/42* (2013.01)

(58) Field of Classification Search
CPC ..... H01Q 1/42
See application file for complete search history.

(56) References Cited

U.S. PATENT DOCUMENTS

2016/0254595 A1* 9/2016 Sobczak ..... H01Q 1/246 343/702
2021/0111485 A1* 4/2021 Mak ..... H01Q 1/40

* cited by examiner

*Primary Examiner* — Hoang V Nguyen
(74) *Attorney, Agent, or Firm* — Seed IP Law Group, LLP

(57) ABSTRACT

An antenna canister component prioritization system identifies antenna canister components compatible with an antenna canister. The antenna canister component prioritization system receives information indicating attributes for an antenna canister and information indicating antenna canister components and attributes for the antenna canister components. The antenna canister component prioritization system determines which antenna canister components are compatible with the antenna canister. The antenna canister component prioritization system prioritizes the compatible antenna canister components and presents the prioritized components to a user.

20 Claims, 8 Drawing Sheets

400 antenna canister component data table

| Component ID | Component Type | Priority | Dimensions |
|---|---|---|---|
| KMW 6 | Antenna | 4 | Vertical: 8'10" Interior Diameter: 29" (401) |
| JMA 4 | Antenna | 1 | Vertical: 8'10" Interior Diameter: 34" (402) |
| Bracket and Triad Mount | Mount | 3 | Diameter: 3"/4" (403) |
| Clamp Bracket and PIPEKIT | Mount | 2 | Diameter: 3.5"/4.5"/5.5" (404) |
| Kaelus | Diplexer | 3 | Clearance: 18" above and 6" below Interior Diameter: 22" (405) |
| Commscope | Diplexer | 1 | Clearance: 18" above and 6" below Interior Diameter: 19.9" (406) |
| Superflex Cable | Cable | 1 | Gender: Male Diameter: 0.5" (407) |
| ... (410) | ... (411) | ... (412) | ... (413) |

*Fig. 4*

500 prioritized antenna canister component list

| Priority | Antenna Part | Mount Part | Feedline Connector Part | Diplexer Part | Diplexer Mount |
|---|---|---|---|---|---|
| 1 | KMW 6 | Antenna Bracket and AB Kit Mount | Female Connector for 1/2" cable | Kaelus Diplexer | Antenna Bracket and AB Kit Mount (501) |
| 2 | KMW 8 | Antenna Bracket and AB Kit Mount | Female Connector for 1/2" cable | Commscope Diplexer | Trio-X (502) |
| 3 | Commscope 6.6 | Antenna Clamp Bracket and 800PIPEKIT-X | Female Connector for 7/8" cable | Kaelus Diplexer | Antenna Bracket and AB Kit Mount (503) |
| ... (510) | ... (511) | ... (512) | ... (513) | ... (514) | ... (515) |

*Fig. 5*

SYSTEMS AND METHODS FOR IDENTIFYING AND PRIORITIZING ANTENNA CANISTER COMPONENTS FOR AN ANTENNA CANISTER

BRIEF SUMMARY

Networks, such as telecommunication networks, 4G/5G networks, broadcast networks, and other types of networks, typically use antennas to provide services to their subscribers. The antennas may include antenna canisters which house the antennas themselves, along with other components used to mount the antenna, make the antenna functional, etc. However, because the various canisters rarely have uniform dimensions, antenna canister components must be selected for each antenna canister which is set up. Furthermore, in order to select the canister components, three-dimensional models must be created for the various canisters and all of the canister components, and each combination of canister components must be tested to determine a combination of components which will fit in the canister.

The embodiments disclosed herein address the issues above and thus help solve the above technical problems and improve the technology of telecommunication antennas by providing a technical solution which identifies antenna canister components which are compatible with an antenna canister. Additionally, the embodiments disclosed herein are able to determine multiple groups of antenna canister components which are compatible with the antenna canister, and to prioritize those groups based on their compatibility with the antenna canister. Furthermore, the embodiments described herein are able to be used to determine whether components in a group are available, and prioritize the groups based on the availability of the components.

In some embodiments, an antenna canister component prioritization system receives information indicating one or more attributes for an antenna canister, receives information indicating one or more antenna canister components and one or more attributes for each antenna canister component, determines which antenna canister components are compatible with the antenna canister based on the attributes of each antenna canister component, prioritizes the antenna canister components compatible with the antenna canister based on the attributes of the antenna canister, and presents the compatible antenna canister components to a user based on the prioritization. In some embodiments, the antenna canister component prioritization system generates a group of antenna canister components which are compatible with the antenna canister as a group. In some embodiments, the antenna canister component prioritization system determines an availability of each antenna canister component and prioritizes the antenna canister components based on the determined availability of the antenna canister component.

BRIEF DESCRIPTION OF THE SEVERAL VIEWS OF THE DRAWINGS

FIG. 4 is a table diagram depicting an antenna canister component data table, according to various embodiments described herein.

FIG. 5 is a table diagram depicting a prioritized antenna canister component list, according to various embodiments described herein.

DETAILED DESCRIPTION

Figure 1:
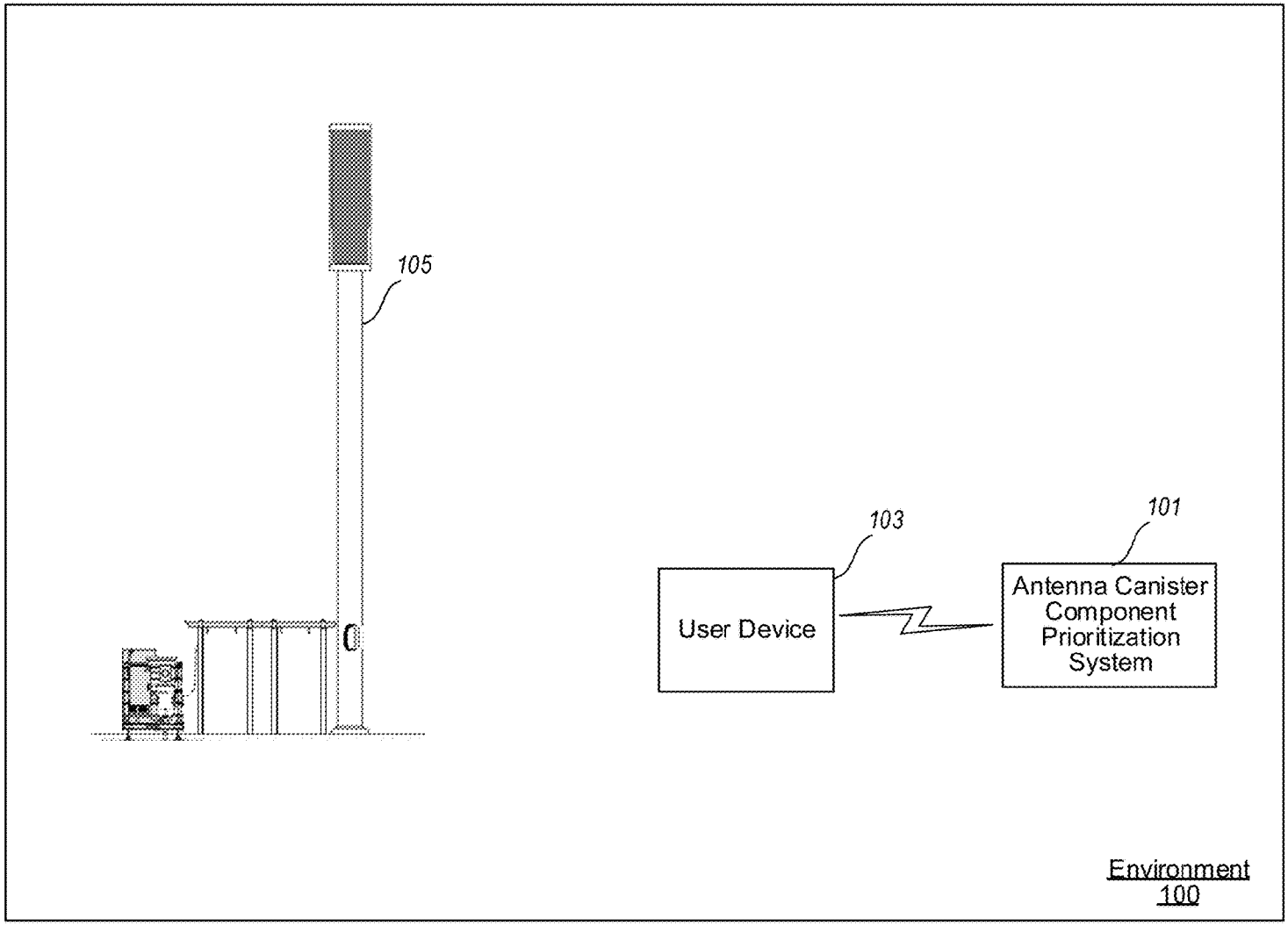
FIG. 1 is a diagram depicting an example environment in which an antenna canister component prioritization system is implemented, according to various embodiments described herein.

Networks providers, such as telecommunication network providers, 4G/5G network providers, broadcast network providers, and other types of network provider, typically use antennas to provide services to their subscribers. When a network provider adds coverage to an area or updates the service provided in the area, the network provider typically installs or updates antennas in the area. The new or updated antenna may include an antenna canister used to house the components which are required to set up or update an antenna ("antenna canister components").

However, the antenna canisters rarely have uniform dimensions. As a result, groups of antenna canister components must be selected for each antenna canister installed. Furthermore, in order to select the components, detailed three-dimensional models must be created and maintained for the antenna canister and the potential components included within the canister. A site engineer must then manually review each of the models to find any combination of components which are compatible with the antenna canister. This combination may not be optimal for the antenna canister. For example, the components may leave a large amount of room within the canister, such that larger, or better, components could have been used. As another example, a component which the site engineer has selected may be unavailable, or may take a long time to obtain relative to other components, and the site engineer may have to find a new combination of components. Because of the large number of possible components for a canister, and because each canister requires multiple components which are each compatible with each other, there are thousands of possible combinations. As a result, the site engineer must go through this time-intensive process each time a new antenna canister is installed.

The embodiments described herein help solve the above technical problems and improve the technology of telecommunication antennas by providing a technical solution which identifies antenna canister components that are compatible with an antenna canister. In some embodiments, the antenna canister component prioritization system identifies at least one group of antenna canister components which are compatible with each other and the antenna canister. In some embodiments, the antenna canister component prioritization system prioritizes antenna canister components based on their availability.

In some embodiments, the antenna canister component prioritization system receives information indicating one or more attributes for an antenna canister. The attributes for the antenna canister may include dimensional attributes, such as a vertical envelope, horizontal space within the canister, the center mast diameter, distance to the ground radios, or other dimensional attributes. The antenna canister attributes may include requirements for the antenna and antenna components used in the canister, such as whether the antenna can tilt, the type of signal that the antenna is transmitting or receiving, etc. The antenna canister component prioritization system may combine the antenna canister attributes to obtain other attributes, such as a radial space available in the canister. The available radial space in the canister may be based on the horizontal space and center mast diameter. In some embodiments, the antenna canister prioritization system receives at least a portion of the information indicating the antenna canister attributes via user input.

In some embodiments, the antenna canister component prioritization system receives information indicating one or more antenna canister components. The information indicating one or more antenna canister components may include information indicating one or more antenna canister component attributes. The information indicating one or more antenna canister components may be obtained from a repository of antenna canister components. The antenna canister component attributes may include dimensional attributes of a component, other components which are preferred to be used with a component, whether the component is able to be used for certain types of signals, whether the component can accommodate tilting the antenna, or other attributes which can describe an antenna canister component. The antenna canister components may be one or more of: an antenna, an antenna mount, a cable, a diplexer, and a bias tee.

In some embodiments, the antenna canister component prioritization system determines which antenna canister components are compatible with the antenna canister. The antenna canister component prioritization system may determine which antenna canister components are compatible by comparing the attributes of each antenna canister component with the antenna canister attributes. The antenna canister component prioritization system may compare the dimensional attributes of the antenna canister components with the antenna canister attributes to determine which antenna canister components fit within the antenna canister. The antenna canister component prioritization system may also compare any requirements for the antenna canister components used in the canister to the attributes of the antenna canister components to determine whether the antenna canister components are compatible with the antenna canister.

In some embodiments, the antenna canister component prioritization system prioritizes the compatible antenna canister components based on the attributes of each antenna canister component and the antenna canister attributes. The antenna canister component may prioritize the compatible antenna canister components based on a measure of how compatible the antenna canister components are with the antenna canister. The antenna canister component prioritization system may prioritize the compatible antenna canister components based on prioritization data included in the antenna canister component attributes. The measure of how compatible the antenna canisters components are with the antenna canister may be obtained based on the amount of space that the antenna canister component occupies in the antenna canister, relative to the dimensions of the antenna canister and the dimensions of the other antenna canister components which will be included in the antenna canister. For example, a component may be rated as more compatible if it occupies as much space in the antenna canister as possible, while still leaving enough space for the other antenna canister components.

In some embodiments, the antenna canister component prioritization system presents the compatible antenna canister components to a user based on the prioritization of the antenna canister components. The antenna canister component prioritization system may present the compatible antenna canister components via a user interface.

In some embodiments, the antenna canister component prioritization system identifies at least one group of antenna canister components which are compatible with the antenna canister as a group. The group of antenna canister components may include at least one antenna, at least one antenna mount, at least one cable, and at least one diplexer. In some embodiments, the group of antenna canister components additionally includes at least one bias tee.

In some embodiments, the antenna canister component prioritization system prioritizes each identified group of antenna canister components. The antenna canister component prioritization system may prioritize each group based on the amount of free space remaining in the canister. The antenna canister component prioritization system may prioritize each group based on the availability of the components in the group. The antenna canister component prioritization system may prioritize each group based on the effectiveness of the group in performing the functions or the intended use of the antenna within the antenna canister, such as the range of the signal, the type of the signal, the amount of devices the antenna will be able to communicate with, or other functions or uses for an antenna.

In some embodiments, the antenna canister component prioritization system determines an availability of each antenna canister component. The antenna canister component prioritization system may prioritize the antenna canister components based on the availability of each antenna canister component. The antenna canister component prioritization system may determine the availability of the antenna canister components by accessing a repository of antenna canister component information.

In some embodiments, the antenna canister component prioritization system presents an antenna canister component user interface to a user. The antenna canister component user interface may receive user input indicating one or more attributes for an antenna canister. The antenna canister component user interface may present the prioritized list of antenna canister components to a user.

In some embodiments, the antenna canister component prioritization system includes an antenna canister component prioritization data structure. The antenna canister component prioritization data structure may include information indicating one or more attributes for the antenna canister. The antenna canister component prioritization data structure may include information indicating one or more antenna canister components and their attributes. The antenna canister component data structure may be used by the antenna canister component prioritization system to identify one or more antenna canister components which are compatible with the antenna canister.

Also, the embodiments disclosed herein improve the functioning of computer or other hardware, such as by reducing the dynamic display area, processing, storage, and/or data transmission resources needed to perform a certain task, thereby enabling the task to be permitted by less capable, capacious, and/or expensive hardware devices, and/or be performed with lesser latency, and/or preserving more of the conserved resources for use in performing other tasks. For example, by identifying a group of antenna canister components compatible with an antenna canister, the three-dimensional modeling typically required to determine which components are compatible with the antenna canister. Thus, the computing resources typically required to determine which components are compatible with the antenna canister is dramatically reduced because no three-dimensional modeling is required to identify the compatible components.

Unless the context requires otherwise, throughout the specification and claims which follow, the word "comprise" and variations thereof, such as, "comprises" and "comprising" are to be construed in an open, inclusive sense, for example "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. The term "or" is generally employed in its sense including "and/or" unless the content clearly dictates otherwise.

The headings and Abstract of the Disclosure provided herein are for convenience only and do not interpret the scope or meaning of the embodiments.

FIG. 1 is a diagram depicting an example environment in which an antenna canister component prioritization system is implemented, according to various embodiments described herein. It is to be appreciated that FIG. 1 illustrates just one example of an environment 100 and that the various embodiments discussed herein are not limited to the use of such an environment. The environment 100 includes an antenna canister component prioritization system 101, a user device 103, and an antenna mast 105. The antenna canister component prioritization system 101 may communicate with the user device 103. In some embodiments, the antenna canister component prioritization system 101 is included in the user device 103.

The environment 100 may include a network, communication system, or networked system (not shown), to which the antenna canister component prioritization system 101, user device 103, and mast 105 may be coupled. Non-limiting examples of such a network or communication system include, but are not limited to, an Ethernet system, twisted pair Ethernet system, an intranet, a local area network (LAN) system, short range wireless network (e.g., Bluetooth®), a personal area network (e.g., a Zigbee network based on the IEEE 802.15.4 specification), a Consumer Electronics Control (CEC) communication system, Wi-Fi, satellite communication systems and networks, cellular networks, cable networks, or the like. One or more endpoint devices, such as PCs, tablets, laptop computers, smartphones, personal assistants, Internet connection devices, wireless LAN, WiFi, Worldwide Interoperability for Microwave Access (WiMax) devices, or the like, may be communicatively coupled to the network and/or to each other so that the plurality of endpoint devices are communicatively coupled together. Thus, such a network enables the antenna canister component prioritization system 101, user device 103, and mast 105, present in the environment 100, to communicate with each other.

The antenna canister component prioritization system 101 identifies antenna canister components compatible with an antenna canister and prioritizes them. The antenna canister component prioritization system 101 may display, or cause a user device 103 to display, an antenna canister component prioritization user interface.

The antenna canister component prioritization system 101, or portions of the antenna canister component prioritization system 101, may be included in a device such as cellular telephones, smartphones, tablets, personal computers, laptop computers, wireless peripheral devices such as headphones, microphones, mice, keyboards, etc., Internet of Things (or "smart") devices, televisions, smart televisions, smart television devices—such as FireTV, Roku, AppleTV, etc.,— personal assistant devices—such as Amazon Alexa, Google Home, etc.,— digital assistants, etc. The antenna canister component prioritization system 101 may interconnect to one or more communications media or sources, such as routers, network switches, modems, etc., to transmit communications to other devices.

The user device 103 may be a user device such as a cellular telephone, smartphone, tablets, personal computer, laptop computer, wireless peripheral device such as a headphone, microphone, a mouse, a keyboard, etc., an Internet of Things (or "smart") device, television, smart television, smart television device—such as FireTV, Roku, AppleTV, etc.,— a personal assistant device—such as Amazon Alexa, Google Home, etc.,— a digital assistant, etc. The user device 103 may interconnect to one or more communications media or sources, such as routers, network switches, modems, etc., to transmit communications to other devices.

The antenna mast 105 is an antenna mast to which an antenna canister may be coupled. The antenna mast 105 may be coupled to one or more ground radios which communicate with one or more computing devices and one or more networks.

The above description of the environment 100, and the various devices and functions therein, is intended as a broad, non-limiting overview of an example environment in which various embodiments of an antenna canister component prioritization system can operate. The environment 100, and the various devices therein, may contain other devices, systems and/or media not specifically described herein. The environment 100, and the various functions therein, may contain other functions, systems and/or media not specifically described herein.

Example embodiments described herein provide applications, tools, data structures and other support to implement systems and methods for identifying antenna canister components compatible with an antenna canister. The example embodiments described herein additionally provide applications, tools, data structures and other support to implement systems and methods for identifying the antenna canister components compatible with an antenna canister. Other embodiments of the described techniques may be used for other purposes, including for identifying groups of antenna canister components which are all compatible with the antenna canister. In the description provided herein, numerous specific details are set forth in order to provide a thorough understanding of the described techniques. The embodiments described also can be practiced without some of the specific details described herein, or with other specific details, such as changes with respect to the ordering of processes or devices, different processes or devices, and the like. Thus, the scope of the techniques and/or functions described are not limited by the particular order, selection, or decomposition of steps described with reference to any particular module, component, or routine.

Figure 2:
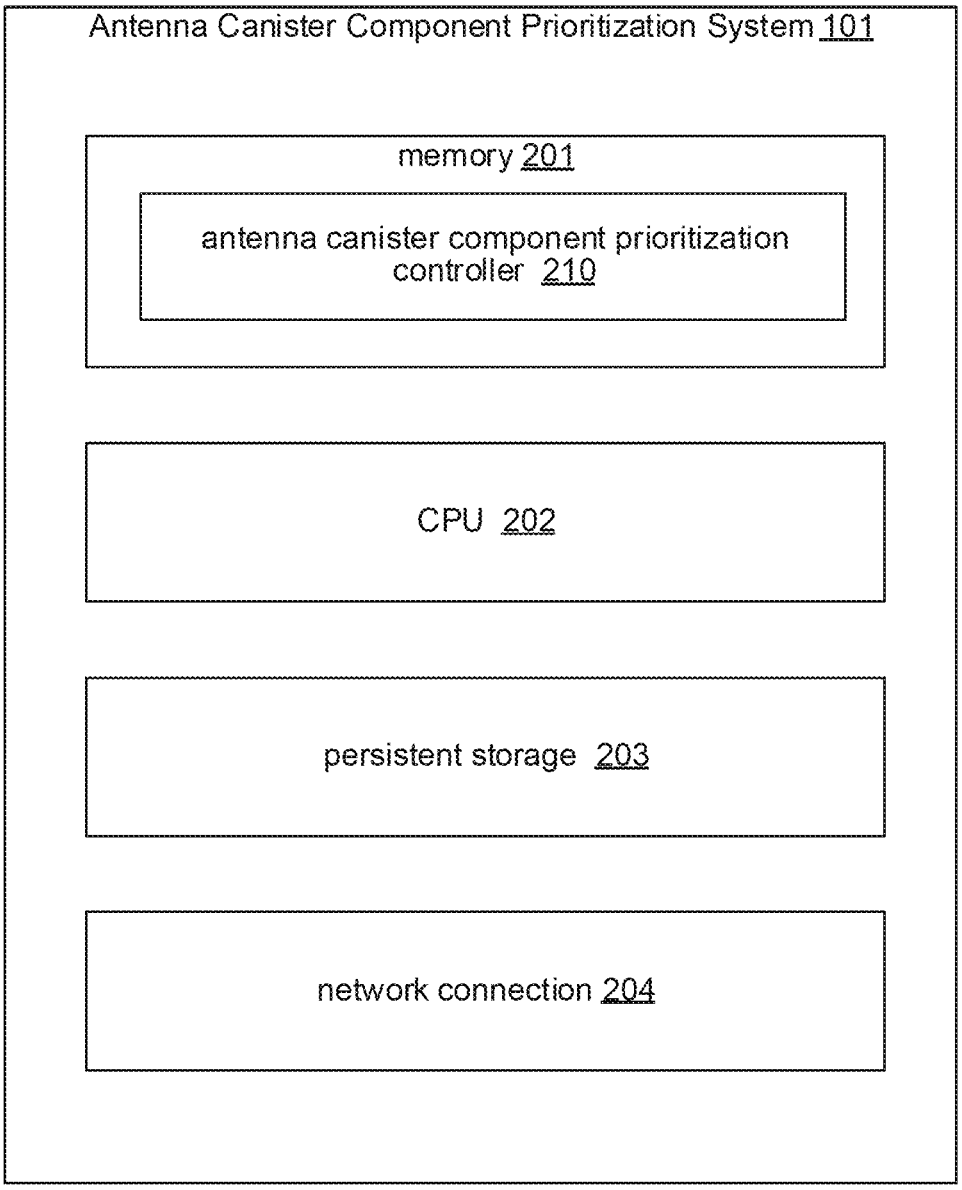
FIG. 2 is a block diagram depicting example components incorporated in an antenna canister component prioritization system, according to various embodiments described herein.

FIG. 2 is a block diagram depicting example components incorporated in an antenna canister component prioritization system 101, according to various embodiments described herein. In various embodiments, the antenna canister component prioritization system 101 includes one or more of the following: a computer memory 201 for storing programs and data while they are being used, including data associated with antenna canisters, antenna canister components, the user device 103, the mast 105, and the antenna canister component prioritization system 101, an operating system including a kernel, and device drivers; a central processing unit (CPU) 202 for executing computer programs; a persistent storage device 203, such as a hard drive or flash drive for persistently storing programs and data, such as an antenna canister component prioritization data structure; and a network connection 204 for connecting to one or more computer devices, user device 103, the network provider's systems (not shown) and/or other computer systems, to send and/or receive data, such as via the Internet or another network and associated networking hardware, such as switches, routers, repeaters, electrical cables and optical fibers, light emitters and receivers, radio transmitters and receivers, and the like. In various embodiments, the antenna canister component prioritization system 101 additionally includes input and output devices, such as a keyboard, a mouse, display devices, etc.

While an antenna canister component prioritization system 101 configured as described may be used in some embodiments, in various other embodiments, the antenna canister component prioritization system 101 may be implemented using devices of various types and configurations, and having various components. The memory 201 may include an antenna canister component prioritization controller 210 which contains computer-executable instructions that, when executed by the CPU 202, cause the antenna canister component prioritization system 101 to perform the operations and functions described herein. For example, the programs referenced above, which may be stored in computer memory 201, may include or be comprised of such computer-executable instructions. The memory 201 may also include data describing the antenna canister, antenna canister components, user device 103, and mast 105.

The antenna canister component prioritization controller 210 performs the core functions of the antenna canister component prioritization system 101, as discussed herein and also with respect to FIGS. 3 through 7. In particular, the antenna canister component prioritization controller 210 changes determines one or more antenna canister components compatible with an antenna canister. Additionally, the antenna canister component prioritization controller 210 may prioritize the antenna canister components based on their compatibility with the antenna canister. The antenna canister component prioritization controller 210 may also identify groups of antenna canister components compatible with the antenna canister such that each of the antenna canister components is able to be included in the antenna canister.

In an example embodiment, the antenna canister component prioritization controller 210 and/or computer-executable instructions stored on memory 201 of the antenna canister component prioritization system 101 are implemented using standard programming techniques. For example, the antenna canister component prioritization controller 210 and/or computer-executable instructions stored on memory 201 of the antenna canister component prioritization system 101 may be implemented as a "native" executable running on CPU 202, along with one or more static or dynamic libraries. In other embodiments, the antenna canister component prioritization controller 210 and/or computer-executable instructions stored on memory 201 of the antenna canister component prioritization system 101 may be implemented as instructions processed by a virtual machine that executes as some other program.

The embodiments described above may also use synchronous or asynchronous client-server computing techniques. However, the various components may be implemented using more monolithic programming techniques as well, for example, as an executable running on a single CPU computer system, or alternatively decomposed using a variety of structuring techniques known in the art, including but not limited to, multiprogramming, multithreading, client-server, or peer-to-peer, running on one or more computer systems each having one or more CPUs. Some embodiments may execute concurrently and asynchronously, and communicate using message passing techniques. Equivalent synchronous embodiments are also supported. Also, other functions could be implemented and/or performed by each component/module, and in different orders, and by different components/modules, yet still achieve the functions of the antenna canister component prioritization system 101.

In addition, programming interfaces to the data stored as part of the antenna canister component prioritization controller 210 can be available by standard mechanisms such as through C, C++, C#, Java, and Web APIs; libraries for accessing files, databases, or other data repositories; through scripting languages such as JavaScript and VBScript; or through Web servers, FTP servers, or other types of servers providing access to stored data. The antenna canister component prioritization controller 210 may be implemented by using one or more database systems, file systems, or any other technique for storing such information, or any combination of the above, including implementations using distributed computing techniques.

Different configurations and locations of programs and data are contemplated for use with techniques described herein. A variety of distributed computing techniques are appropriate for implementing the components of the embodiments in a distributed manner including but not limited to TCP/IP sockets, RPC, RMI, HTTP, Web Services (XML-RPC, JAX-RPC, SOAP, and the like). Other variations are possible. Also, other functionality could be provided by each component/module, or existing functionality could be distributed amongst the components/modules in different ways, yet still achieve the functions of antenna canister component prioritization system 101, user device 103, and/or mast 105.

Furthermore, in some embodiments, some or all of the components/portions of the antenna canister component prioritization controller 210, and/or functionality provided by the computer-executable instructions stored on memory 201 of the antenna canister component prioritization system 101 may be implemented or provided in other manners, such as at least partially in firmware and/or hardware, including, but not limited to, one or more application-specific integrated circuits (ASICs), standard integrated circuits, controllers (e.g., by executing appropriate instructions, and including microcontrollers and/or embedded controllers), field-programmable gate arrays (FPGAs), complex programmable logic devices (CPLDs), and the like. Some or all of the system components and/or data structures may also be stored as contents (e.g., as executable or other machine-readable software instructions or structured data) on a computer-readable medium (e.g., as a hard disk; a memory; a computer network or cellular wireless network; or a portable media article to be read by an appropriate drive or via an appropriate connection, such as a DVD or flash memory device) so as to enable or configure the computer-readable medium and/or one or more associated computing systems or devices to execute or otherwise use or provide the contents to perform at least some of the described techniques. Such computer program products may also take other forms in other embodiments. Accordingly, embodiments of this disclosure may be practiced with other computer system configurations.

In general, a range of programming languages may be employed for implementing any of the functionality of the servers, functions, user equipment, etc., present in the example embodiments, including representative implementations of various programming language paradigms and platforms, including but not limited to, object-oriented (e.g., Java, C++, C#, Visual Basic.NET, Smalltalk, and the like), functional (e.g., ML, Lisp, Scheme, and the like), procedural (e.g., C, Pascal, Ada, Modula, and the like), scripting (e.g., Perl, Ruby, PHP, Python, JavaScript, VBScript, and the like) and declarative (e.g., SQL, Prolog, and the like).

Figure 3A:
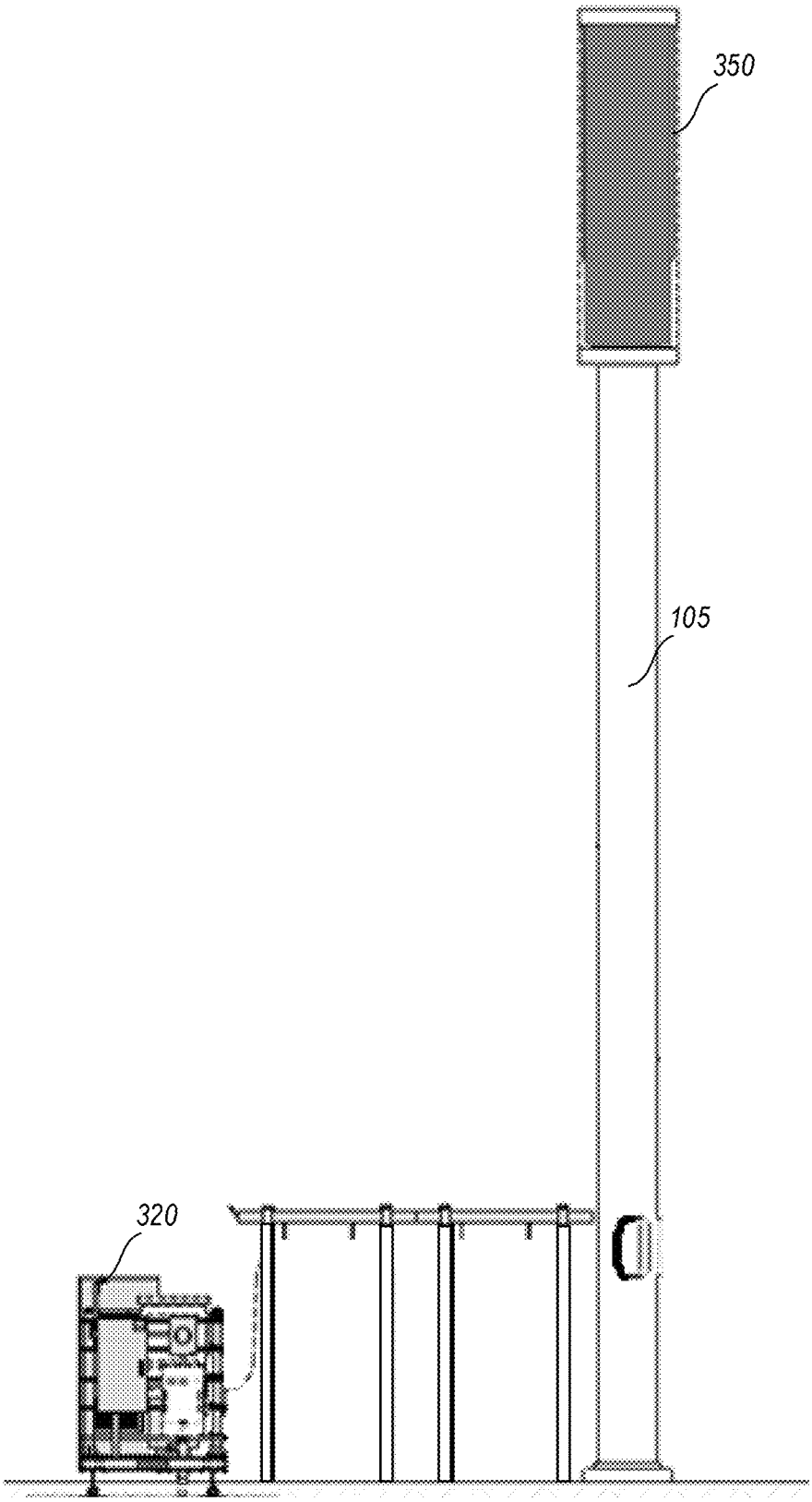
FIG. 3*a* is display diagram depicting an antenna mast, according to various embodiments described herein.

FIG. 3*a* is display diagram depicting an antenna mast 105, according to various embodiments described herein. The antenna mast 105 includes an antenna canister 350 and a ground radio system 320. The antenna canister 350 may include antenna canister components which are compatible with the antenna canister 350.

Figure 3C:
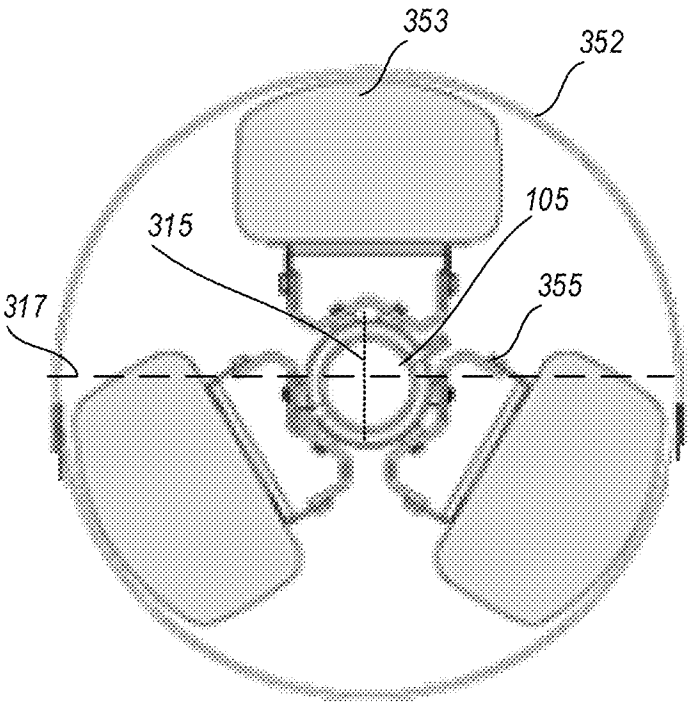
FIG. 3*c* is a display diagram depicting a top-down view of the antenna housing, according to various embodiments described herein.
Figure 3B:
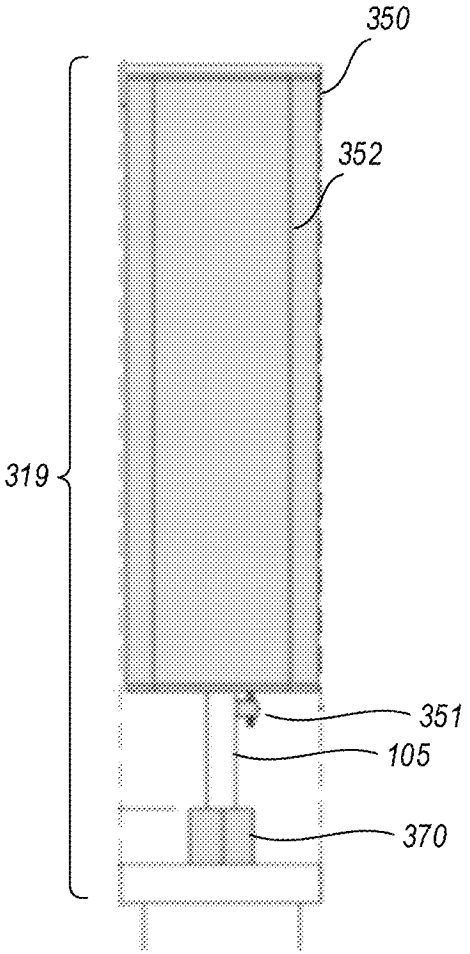
FIG. 3*b* is a display diagram depicting an antenna canister, according to various embodiments described herein.

FIG. 3*b* is a display diagram depicting an antenna canister 350, according to various embodiments described herein. The antenna canister 350 is denoted by the dotted lines, and includes an antenna housing 352, a diplexer 351, and a bias tee 370. In some embodiments, the antenna canister 350 does not include the bias tee 370. The antenna housing 352 includes the antennas and brackets for the antennas, which are described further in FIG. 3*c*. The diplexer 351 is a device which implements frequency-domain multiplexing. The diplexer 351 may operate in conjunction with a bias tee 370. The bias tee 370 implements a three-port network used for setting the direct current bias point of at least a portion of the antenna canister components included in the antenna canister.

FIG. 3*b* additionally includes a vertical envelope 319. The vertical envelope 319 is a dimensional measurement of the vertical height of the antenna canister 350.

FIG. 3*c* is a display diagram depicting a top-down view of the antenna housing 352, according to various embodiments described herein. The antenna housing 352 includes one or more antennas 353 and one or more antenna brackets 355. The antenna brackets 355 are used to attach the antennas to the mast 105.

FIG. 3*c* additionally includes an antenna canister diameter 317 and a center mast diameter 315. The antenna canister diameter 317 is a dimensional measurement of the inner diameter of the antenna canister 350. The center mast diameter 315 is a dimensional measurement of the diameter of the center mast 105. The antenna canister diameter 317, center mast diameter 315, and vertical envelope 319 may be used to determine the space available inside of the antenna canister 350 for antenna canister components.

FIG. 4 is a table diagram depicting an antenna canister component data table 400, according to various embodiments described herein. The antenna canister component data table 400 includes data describing the various antenna canister components which may be included in an antenna canister. The antenna canister component data table 400 includes a component ID column 410, a component type column 411, a priority column 412, and a dimensions column 413.

The component ID column 410 includes information identifying an antenna canister component. The component type column 411 includes information identifying the type of component identified in the component ID column 410. The priority column 412 includes information identifying a priority for the component identifying in the component ID column 410. The information identifying a priority may indicate to the antenna canister component prioritization system which antenna canister components a network provider prefers to include in the antenna canister. The dimensions column 413 includes information identifying the dimensions of the component identified in the component ID column 410.

In some embodiments, the antenna canister component data table 400 includes one or more of: additional information for the antenna canister component, such as the availability of the component (not shown); notes regarding the requirements for each antenna canister component, such as how the component modifies the antenna, the range, signal strength, or frequency type of the antenna, and other information related to the antenna canister component.

For example, row 401 identifies a "KMW 6" antenna, with a priority of 4, and vertical dimensions of 8 feet 10 inches, and an interior diameter of 29 inches. Likewise, row 403 identifies a "Bracket and Triad Mount," which is a mount with priority 3, and a diameter of either 3 inches or 4 inches. Row 406 indicates a "Commscope" diplexer with a priority of 1 and a clearance of 18 inches above and 6 inches below, and an interior diameter of 22 inches. Row 407 indicates a "Superflex Cable," which is a cable with priority of 1, a male connecter, and a 0.5 inch diameter.

FIG. 5 is a table diagram depicting a prioritized antenna canister component list 500, according to various embodiments described herein. The prioritized antenna canister component list 500 is generated by the antenna canister component prioritization system to recommend antenna canister components compatible with an antenna canister. The prioritized antenna canister component list includes a priority column 510, an antenna part column 511, a mount part column 512, a feedline connector part column 513, a diplexer part column 514, and a diplexer mount column 515. In some embodiments, the prioritized antenna canister component list 500 may also include a bias tee column (not shown) indicating a bias tee compatible with the other antenna canister components in each row. The priority column 510 includes information indicating the priority of the group of antenna canister components in the row. The priority of the group indicates to a user which group of antenna canister components is most compatible with the antenna canister.

The antenna part column 511 includes information indicating an antenna compatible with the antenna canister. The mount part column 512 includes information indicating a mount for the antenna compatible with the antenna canister. The feedline connecter part column 513 includes information indicating a cable for the antenna compatible with the antenna canister. The diplexer part column 514 includes information identifying a diplexer compatible with the antenna and the other components compatible with the antenna canister. The diplexer mount column 515 includes information identifying a diplexer mount compatible with the diplexer and other antenna canister components compatible with the antenna canister.

For example, row 501 indicates that the top priority group of antenna canister components includes a KMW 6 antenna, an Antenna Bracket and AB Kit Mount, a Female Connector for a ½ inch cable, a Kaelus Diplexer, and an Antenna Bracket and AB Kit Mount for the diplexer. Likewise, row 503 indicates the third best group of antenna components, which include a Commscope 6.6 antenna, Antenna Clamp Bracket and 800PIPEKIT-X mount, a Female connector for a ⅞ inch cable, a Kaelus Diplexer, and an Antenna Bracket and AB Kit Mount for the diplexer.

Figure 6:
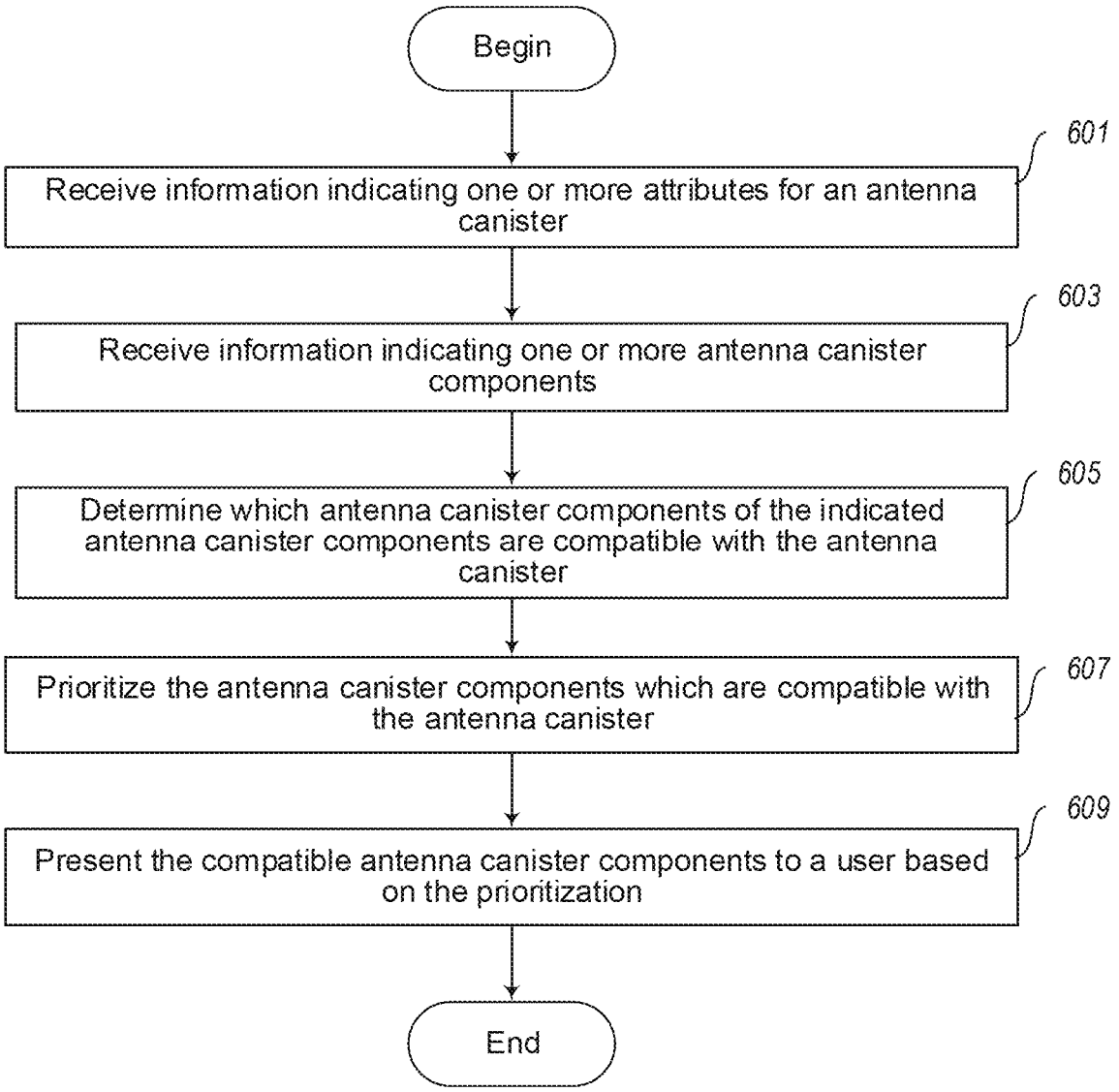
FIG. 6 is a flow diagram depicting a process for identifying antenna canister components compatible with an antenna canister, according to various embodiments described herein.

FIG. 6 is a flow diagram depicting a process for identifying antenna canister components compatible with an antenna canister, according to various embodiments described herein. At act 601, the antenna canister component prioritization system receives information indicating one or more attributes for an antenna canister. The information indicating the antenna canister attributes may be received via user input. In some embodiments, the antenna canister component prioritization system additionally receives a purpose, goal, function, etc., for the antenna included in the antenna canister at act 601.

At act 603, the antenna canister component prioritization system receives information indicating one or more antenna canister components. The information indicating antenna canister components includes information indicating attributes of the antenna canister components. In some embodiments, the antenna canister component prioritization system receives the information indicating the antenna canister components from a repository of antenna canister component data.

At act 605, the antenna canister component prioritization system determines which antenna canister components are compatible with the antenna canister. The antenna canister component prioritization system may determine whether an antenna canister component is compatible with the antenna canister by comparing the attributes of the antenna canister component with the attributes of the antenna canister.

At act 607, the antenna canister component prioritization system prioritizes the antenna canister components which are compatible with the antenna canister. The antenna canister component prioritization system may prioritize the compatible antenna canister components based on one or more of: prioritization data for the antenna canister components; the availability of antenna canister components; a comparison of the antenna canister component attributes to the antenna canister attributes; and a purpose, goal, or function of the antenna.

At act 609, the antenna canister component prioritization system presents the compatible antenna canister components to a user based on the prioritization of the antenna canister components. In some embodiments, the compatible components are presented to the user via a user device.

After act 609, the process ends.

Figure 7:
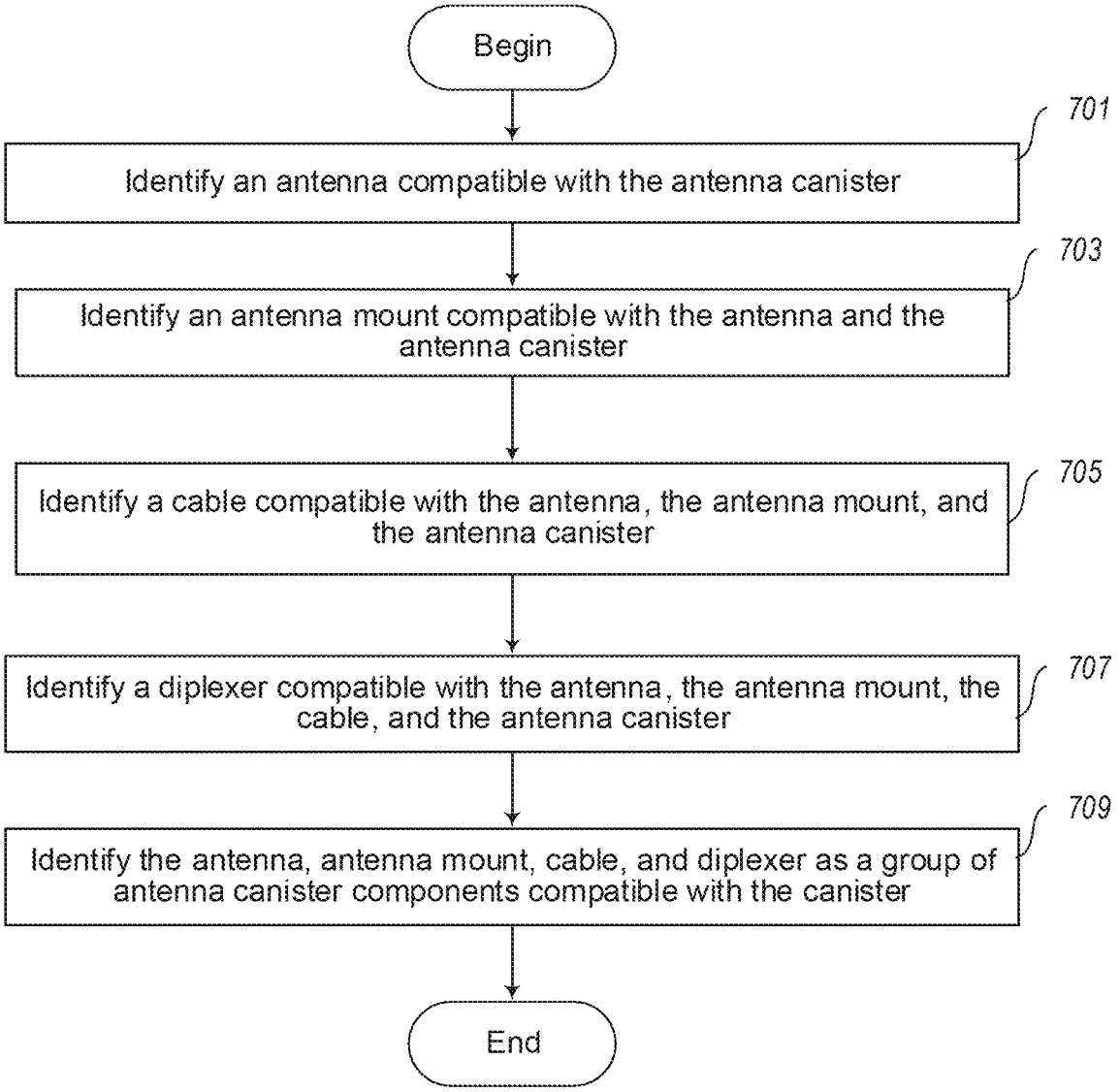
FIG. 7 is a flow diagram depicting a process to identify a group of antenna canister components compatible with the antenna canister, according to some embodiments described herein.

FIG. 7 is a flow diagram depicting a process to identify a group of antenna canister components compatible with the antenna canister, according to some embodiments described herein. At act 701, the antenna canister component prioritization system identifies an antenna compatible with the antenna canister.

At act 703, the antenna canister component prioritization system identifies an antenna mount compatible with the antenna and the antenna canister.

At act 705, the antenna canister component prioritization system identifies a cable compatible with the antenna, the antenna canister, and the antenna mount.

At act 707, the antenna canister component prioritization system identifies a diplexer compatible with the antenna, the antenna mount, the cable, and the antenna canister.

At act 709, the antenna canister component prioritization system identifies the diplexer, the antenna, the antenna mount, and the cable as a group of antenna canister components compatible with the antenna canister.

After act 709, the process ends. In some embodiments, the antenna canister component prioritization system identifies a diplexer mount compatible with the group of antenna canister components and the antenna canister. In some embodiments, the antenna canister component prioritization system identifies a bias tee compatible with the group of antenna canister components and the antenna canister.

In some embodiments, the identification of the component being compatible with the antenna canister and the other antenna canister components in acts 701-709 is based on a comparison of the antenna canister attributes and the attributes of each component with the antenna canister and the other components.

In some embodiments, the process depicted in FIG. 7 is performed by using nested loops. For example, in such embodiments, after the antenna is identified, the antenna canister component prioritization system checks each antenna mount for compatibility with the antenna. Once a compatible antenna mount is found, the antenna canister component prioritization system checks each cable for compatibility with the antenna and the antenna mount. If there are no compatible cables, the antenna canister component prioritization system checks the mounts again to determine if there is a second mount compatible with the antenna. Once the second mount is identified, the antenna canister component prioritization system then checks each cable again to determine whether there is a cable compatible with the antenna and the second antenna mount. The antenna canister component continues this process until each component is identified for the group. The group is then identified as a group of components compatible with each other and with the antenna canister.

In some embodiments, after identifying one or more groups of antenna canister components, such as through the process described in FIG. 7, the antenna canister component prioritization system prioritizes the groups of antenna canister components.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A system comprising:

at least one processor; and at least one memory coupled to the at least one processor, the memory having computer-executable instructions stored thereon that, when executed by the at least one processor, cause the system to:

electronically receive information indicating one or more attributes for an antenna canister;

electronically receive information indicating one or more antenna canister components, the information indicating one or more antenna canister components including information indicating one or more attributes for each antenna canister component;

electronically determine which antenna canister components of the indicated antenna canister components are compatible with the antenna canister based on the one or more antenna canister attributes and the one or more attributes for each antenna canister component;

electronically prioritize the antenna canister components which are compatible with the antenna canister based on the one or more antenna canister attributes and the one or more attributes for each antenna canister component; and electronically present the compatible antenna canister components to a user based on the prioritization of the antenna canister components.

2. The system of claim 1, wherein the one or more attributes of the antenna canister include one or more of: vertical space, diameter, center mast diameter, or distance from ground radios to the canister.

3. The system of claim 2, wherein the one or more antenna canister components include one or more of: an antenna, an antenna mount, a cable, or a diplexer.

4. The system of claim 3, wherein determining which antenna canister components are compatible with the antenna canister further comprises:

electronically identifying one or more groups of antenna canister components which fit within the antenna canister based on the one or more attributes of each antenna canister component in the group and the one or more attributes of the antenna canister, wherein each group includes:

at least one antenna;

at least one antenna mount;

at least one cable; and at least one diplexer; and electronically present the one or more groups of antenna canister components to the user.

5. The system of claim 4, wherein prioritizing the antenna canister components further comprises:

for each group of the one or more groups, electronically determining the amount of free space available in the antenna canister component based on the one or more attributes of each antenna canister component in the group and the one or more attributes of the antenna canister; and electronically prioritizing each group of the one or more groups based on the determined amount of free space available in the antenna canister component for each group.

6. The system of claim 3, wherein the one or more antenna canister components further include a bias tee.

7. The system of claim 1, wherein prioritizing the antenna canister components further comprises:

electronically determining an availability of each antenna canister component; and electronically prioritizing the antenna canister components based on the availability of each antenna canister component.

8. The system of claim 1, wherein the one or more attributes of each antenna canister component includes one or more of: site coverage, frequency bands, or cost of the component.

9. The system of claim 1, wherein electronically receiving information indicating one or more attributes of an antenna canister further comprises:

electronically presenting an antenna canister component prioritization user interface to a user; and electronically receiving user input indicating the information indicating one or more attributes of the antenna canister via the antenna canister component prioritization user interface.

10. One or more storage devices collectively storing an antenna component prioritization data structure for access and processing by a program executed by at least one computer processor that, when accessed and processed by the at least one computer processor, functionally enables the at least one computer processor to:

identify antenna canister components compatible with an antenna canister; and prioritize the antenna canister components, the antenna component prioritization data structure comprising:

information indicating one or more attributes for the antenna canister; and information indicating one or more antenna canister components, the information indicating one or more antenna canister components including information indicating one or more attributes for each antenna canister component, such that the information indicating one or more attributes for the antenna canister and the information indicating one or more antenna canister components are usable to determine whether the antenna canister components are compatible with the antenna canister, and such that the information indicating one or more attributes of the antenna canister and the information indicating the one or more antenna canister components which are compatible with the antenna canister are able to be used to prioritize the antenna canister components.

11. The one or more storage devices of claim 10, wherein the one or more attributes of the antenna canister include one or more of: vertical space, diameter, center mast diameter, or distance from ground radios to the canister.

12. The one or more storage devices of claim 10, wherein the one or more antenna canister components include one or more of: an antenna, an antenna mount, a cable, or a diplexer.

13. The one or more storage devices of claim 12, wherein the antenna canister component prioritization data structure further comprises one or more groups of antenna canister components, the one or more groups of antenna canister components comprising:

at least one antenna;

at least one antenna mount;

at least one cable; and at least one diplexer, such that each group of antenna canister components is able to be included within antenna canister with the other antenna canister components in the respective group of antenna canister components.

14. The one or more storage devices of claim 12, wherein the one or more antenna canister components further include a bias tee.

15. The one or more storage devices of claim 10, wherein the one or more attributes of each antenna canister component includes one or more of: site coverage, frequency bands, or cost of the component.

16. A method in an antenna canister component prioritization system, the method comprising:

receiving information indicating one or more attributes for an antenna canister;

receiving information indicating one or more antenna canister components, the information indicating one or more antenna canister components including information indicating one or more attributes for each antenna canister component;

determining which antenna canister components of the indicated antenna canister components are compatible with the antenna canister based on the one or more antenna canister attributes and the one or more attributes for each antenna canister component;

prioritizing the antenna canister components which are compatible with the antenna canister based on the one or more antenna canister attributes and the one or more attributes for each antenna canister component; and presenting the compatible antenna canister components to a user based on the prioritization of the antenna canister components.

17. The method of claim 16, wherein determining which antenna canister components are compatible with the antenna canister further comprises:

identifying one or more groups of antenna canister components which fit within the antenna canister based on the one or more attributes of each antenna canister component in the group and the one or more attributes of the antenna canister, wherein each group includes:

at least one antenna;

at least one antenna mount;

at least one cable; and at least one diplexer; and presenting the one or more groups of antenna canister components to the user.

18. The method of claim 17, wherein prioritizing the antenna canister components further comprises:

for each group of the one or more groups, determining the amount of free space available in the antenna canister component based on the one or more attributes of each antenna canister component in the group and the one or more attributes of the antenna canister; and prioritizing each group of the one or more groups based on the determined amount of free space available in the antenna canister component for each group.

19. The method of claim 16, wherein prioritizing the antenna canister components further comprises:

determining an availability of each antenna canister component; and prioritizing the antenna canister components based on the availability of each antenna canister component.

20. The method of claim 16, wherein receiving information indicating one or more attributes of an antenna canister further comprises:

presenting an antenna canister component prioritization user interface to a user; and receiving user input indicating the information indicating one or more attributes of the antenna canister via the antenna canister component prioritization user interface.

* * * * *